US006666344B1

(12) United States Patent
Schneider

(10) Patent No.: US 6,666,344 B1
(45) Date of Patent: Dec. 23, 2003

(54) BOOK SHELF SUPPORT FOR STANDING ON A FLOOR AND UNATTACHABLY ABUTTING AGAINST A WALL

(76) Inventor: Wallace Schneider, 41W. 72nd St., #8A, New York, NY (US) 10023-3483

( * ) Notice: Subject to any disclaimer, the term of this patent is extended or adjusted under 35 U.S.C. 154(b) by 0 days.

(21) Appl. No.: 10/114,380

(22) Filed: Apr. 2, 2002

(51) Int. Cl.[7] ..... A47F 5/08; A47B 57/06

(52) U.S. Cl. ..... 211/90.02; 211/175; 211/201; 248/172; 248/188.6; 248/171

(58) Field of Search ..... 211/90.01, 90.02, 211/175, 201; 248/188.6, 172, 440.1, 164, 431, 171

(56) References Cited

U.S. PATENT DOCUMENTS 878,043 A * 2/1908 Chrisman ..... 248/616
1,151,291 A * 8/1915 Sampson ..... 211/175
2,928,512 A 3/1960 Slater et al.
4,753,354 A 6/1988 Patterson et al.
5,161,701 A * 11/1992 Berny ..... 211/193
5,234,116 A * 8/1993 Kristinsson et al. ..... 211/201
5,477,789 A * 12/1995 Von Gunten ..... 211/90.01
5,738,019 A * 4/1998 Parker ..... 211/175
6,105,794 A 8/2000 Bauer
6,227,756 B1 5/2001 Dube et al.
6,260,489 B1 7/2001 Weaver et al.
6,422,407 B2 * 7/2002 Arai ..... 211/175
6,488,160 B2 * 12/2002 Wang ..... 211/195

* cited by examiner

*Primary Examiner*—Daniel P. Stodola
*Assistant Examiner*—Erica B Harris
(74) *Attorney, Agent, or Firm*—Richard L. Miller

(57) ABSTRACT

A book shelf support for standing on a floor and unattachably abutting against a wall. The book shelf support includes a pair of uprights and a pair of criss-cross braces. The pair of uprights stand on the floor and unattachably abut against the wall. The pair of criss-cross braces attach the pair of uprights to each other. Each upright of the pair of uprights has a lowermost end that extends inwardly away from the wall and downwardly onto the floor, and as a result thereof, allows the support to stand on the floor and unattachably abut against the wall. Each brace of the pair of criss-cross braces includes two pieces that telescope relative to each other so as to allow for length adjustment and relative orientation of the pair of criss-cross braces.

5 Claims, 2 Drawing Sheets

BOOK SHELF SUPPORT FOR STANDING ON A FLOOR AND UNATTACHABLY ABUTTING AGAINST A WALL

BACKGROUND OF THE INVENTION

1. Field of the Invention

The present invention relates to a book shelf. More particularly, the present invention relates to a book shelf support for standing on a floor and unattachably abutting against a wall.

2. Description of the Prior Art

Numerous innovations for supports have been provided in the prior art that will be described. Even though these innovations may be suitable for the specific individual purposes to which they address, however, they differ from the present invention.

A FIRST EXAMPLE, U.S. Pat. No. 2,928,512 to Slater et. al teaches a structural assembly to support an article in a fixed position, comprising: an elongated structural member having a channel extending the full length thereof, means defining a slot opening to said channel, one edge of said slot opening having teeth thereon, a toothed member within said slot in engagement with said slot teeth, a fastening member engaged within said channel projecting outwardly therefrom into engagement with said article to support said article, and means defining an opening in said toothed member to receive said fastening member, the center of said opening being positioned on a line normal to said teeth with said line passing through one tooth at the midpoint between the high point of said tooth and one of the adjoining low points of said tooth whereby turning said toothed member will move the center of said opening relative to said structural member.

A SECOND EXAMPLE, U.S. Pat. No. 4,753,354 to Patterson et. al teaches an adapter which comprises a pre-manufactured assembly capable of infinite vertical adjustment and self-adjusting width capability. To this end, the adapter of the present invention comprises a two-part unit in which the two parts thereof are relatively shiftable widthwise of the rack, yet a first of the part is telescoped within the second part and secured by screws to the adjacent side of the chassis unit to be mounted. The second part of the adapter can be snap-fitted into the central, hollow portion of a vertical rail of the rack and normally remains stationary with respect to such rail; whereas, the first part of the adapter can be inserted into the second part before the second part is inserted into the hollow center portion of the rail.

A THIRD EXAMPLE, U.S. Pat. No. 6,105,794 to Bauer teaches an adjustable support bracket having a unitary or multi-member bracket assembly that can be used with a vertical channel and rail construction. Each bracket assembly can be positioned and secured at any location along the rail and can accommodate a varying shelf thickness. More specifically, the multi-member bracket assembly includes a stabilizer member and a support member having similar shaped channel plates which when joined have a similar shape to the channel. A spring mounted between the stabilizer and support members is contained between the rails. The spring in conjunction with a containing lip and a supporting lip of the stabilizer and support members, respectively, adjusts to clamp a shelf therebetween. A securing screw looks the bracket at any shelving location by creating a space between the stabilizer and support members within the vertical channel.

A FOURTH EXAMPLE, U.S. Pat. No. 6,227,756 to Dube et al. teaches a mounting assembly that is for adjustably mounting an accessory having a substantially planar portion onto a rail member having a longitudinal side channel with opposite longitudinal folds. The mounting assembly has an elongated latch member shaped for passage between the folds when the latch member is oriented substantially parallel to the channel, and for against the folds when the latch member is turned at least partially transversely inside the channel. The mounting assembly has a tightening device for tightening the accessory to the latch member. A locking device is operatively associated with the planar portion of the accessory and the latch member to prevent relative rotation and translation thereof when the accessory is tighten to the latch member.

A FIFTH EXAMPLE, U.S. Pat. No. 6,260,489 to Weaver et al. teaches a system for hanging implements on a wall which employs a hanging component formed of thin steel wire having two wire legs integrally Joined to and spaced apart at a limited portion. In a shelf supporting embodiment, bores or paired channels are provided within a shelf standard at a downwardly depending acute angle. The standard then is used with an elemental drill to form corresponding paired channels through a drywall surface. The wire bifurcate hanging components then are inserted through these channels at the noted acute angle to support a standard against a wall. The acute angle evokes an, inwardly directed vector component providing a very stable and relatively high load bearing capacity. Removal of the shelf system from the wall is simply accomplished by lifting upwardly to reveal only small paired channel openings which are easily covered or resurfaced. A continuous strap based self supporting arrangement simplifies the mounting to and supporting of shelves from spaced apart standards.

It is apparent that numerous innovations for supports have been provided in the prior art that are adapted to be used. Furthermore. even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a book shelf support for standing on a floor and unattachably abutting against a wall that avoids the disadvantages of the prior art.

ANOTHER OBJECT of the present invention is to provide a book shelf support for standing on a floor and unattachably abutting against a wall that is simple and inexpensive to manufacture.

STILL AND ANOTHER OBJECT of the present invention is to provide a book shelf support for standing on a floor and unattachably abutting against a wall that is simple to use.

BRIEFLY STATED, STILL YET ANOTHER OBJECT of the present invention is to provide a book shelf support for standing on a floor and unattachably abutting against a wall. The book shelf support includes a pair of uprights and a pair of criss-cross braces. The pair of uprights stand on the floor and unattachably abut against the wall. The pair of criss-cross braces attach the pair of uprights to each other. Each upright of the pair of uprights has a lowermost end that extends inwardly away from the wall and downwardly onto the floor, and as a result thereof, allows the support to stand on the floor and unattachably abut against the wall. Each brace of the pair of criss-cross braces includes two pieces that telescope relative to each other so as to allow for length adjustment and relative orientation of the pair of criss-cross braces.

The novel features which are considered characteristic of the present invention are set forth: in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE UTILIZED IN THE DRAWING

Figure 1:
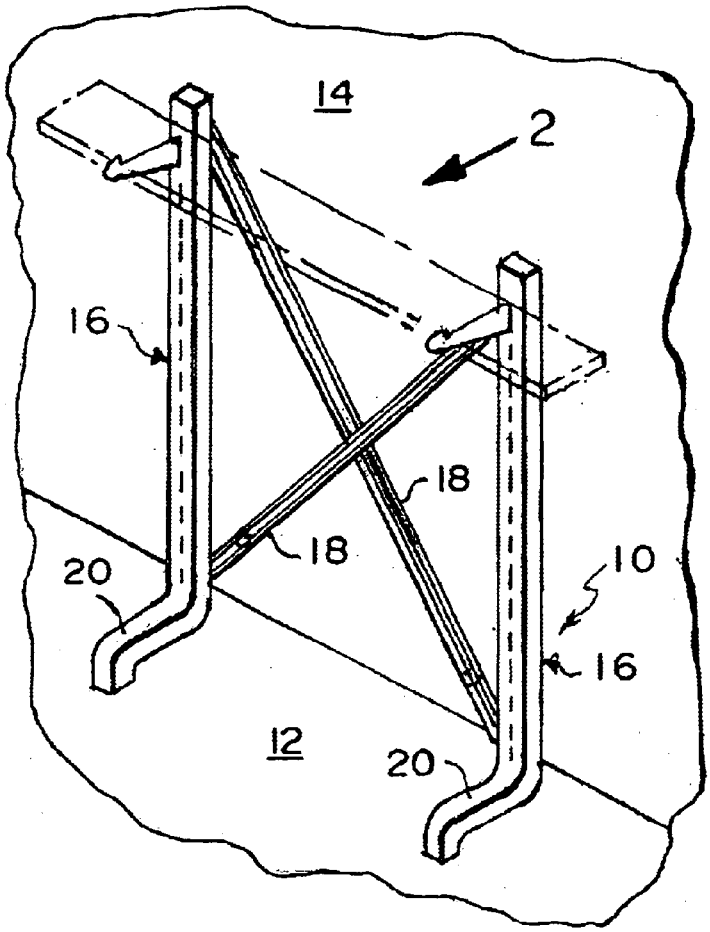
FIG. 1 is a diagrammatic perspective view of the present invention in use.

10 book shelf support of present invention for standing on floor 12 and unattachably abutting against wall 14
12 floor
14 wall
16 pair of uprights for standing on floor 12 and unattachably abutting against wall 14
18 pair of criss-cross braces
20 lowermost end of each upright of pair of uprights 16
22 two pieces of each brace of pair of crisscross braces 18
24 throughslot through each piece of two pieces 22 of each brace of pair of crisscross braces 18
26 plate of each brace of pair of cries-cross braces 18
28 inner piece of two pieces 22 of each brace of pair of cries-cross braces 18
30 throughbore through plate 26 of one brace of pair of criss-cross braces 18
32 threaded rod of plate 26 of other brace of pair of criss-cross braces 18
34 outer piece of each brace of pair of criss-cross braces 18
36 wing nut of pair of cries-cross braces 18

DETAILED DESCRIPTION OF THE PREFERRED EMBODIMENT

Referring now to the figures, in which like numerals indicate like parts, and particularly to FIG. 1, the book shelf support of the present invention is shown generally at 10 for standing on a floor 12 and unattachably abutting against a wall 14.

The overall configuration of the book shelf support 10 can best be seen in FIG. 1, and as such, will be discussed with reference thereto.

The book shelf support 10 comprises a pair of uprights 16, and a pair of cries-cross braces 18.

The pair of uprights 16 are for standing on the floor 12 and unattachably abutting against the wall 14.

The pair of criss-cross braces 18 attach the pair of uprights 16 to each other.

Each upright of the pair of uprights 16 has a lowermost end 20.

The lowermost end 20 of each upright of the pair of uprights 16 extends inwardly away from the wall 14 and downwardly onto the floor 12, and as a result thereof, allows the book shelf support 10 to stand on the floor 12 and unattachably abut against the wall 14.

Figure 2:
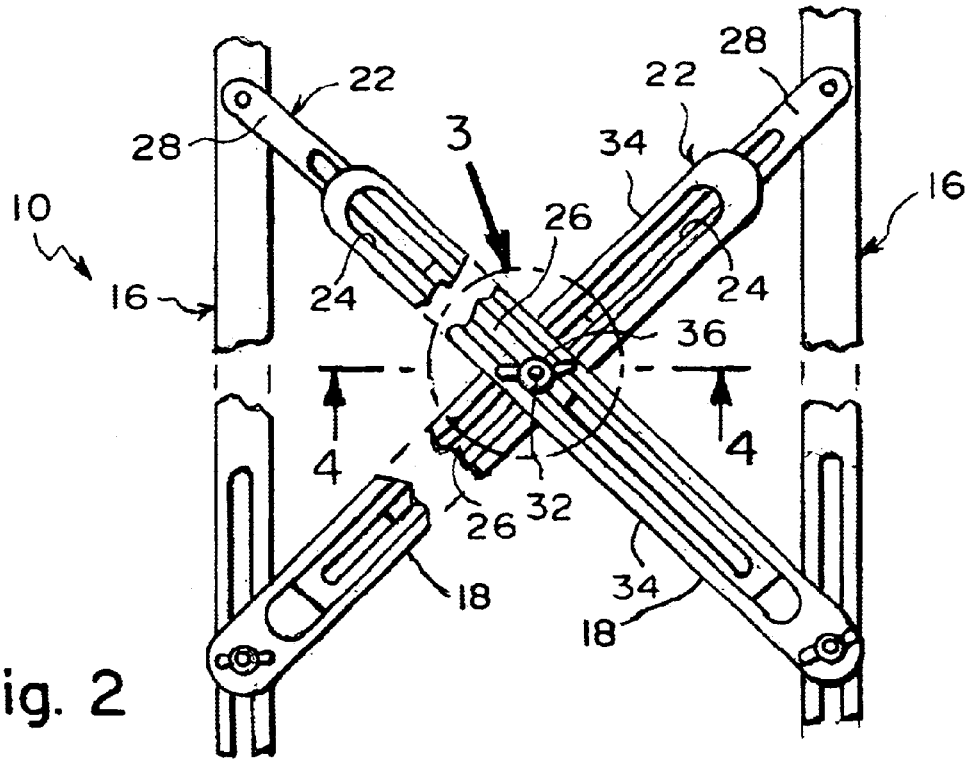
FIG. 2 is an enlarged diagrammatic rear end view taken generally in the direction of ARROW 2 in FIG. 1.
Figure 3:
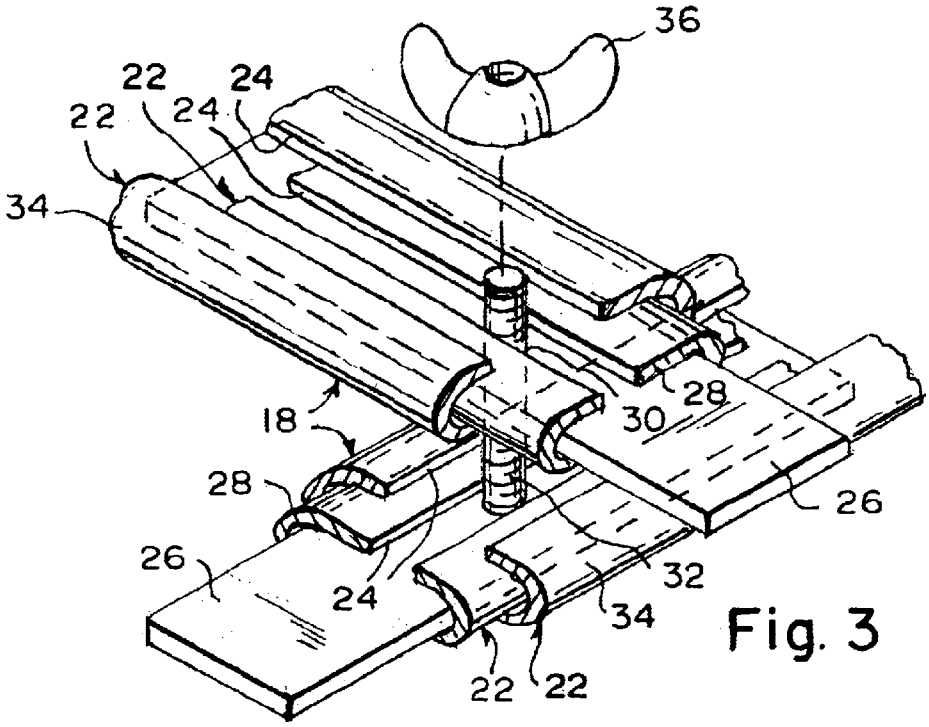
FIG. 3 is an enlarged diagrammatic perspective view of the area generally enclosed by the dotted curve identified by ARROW 3 in FIG. 2.
Figure 4:
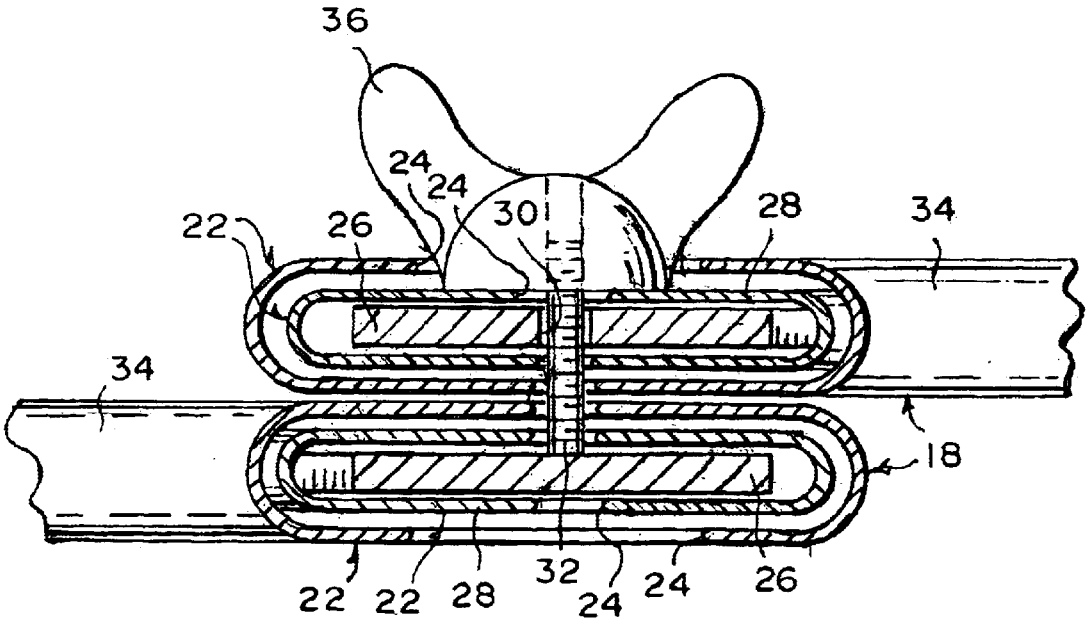
FIG. 4 is an enlarged diagrammatic cross sectional view taken on LINE 4—4 in FIG. 2.

The specific configuration of the pair of cries-cross braces 18 can best be seen in FIGS. 2–4, and as such, will be discussed with reference thereto.

Each brace of the pair of criss-cross braces 18 comprises two pieces 22.

The two pieces 22 of each brace of the pair of criss-cross braces 18 telescope relative to each other; respectively.

Each piece of the two pieces 22 of each brace of the pair of criss-cross braces 18 has a throughslot 24.

The throughslot 24 extends longitudinally along each piece of the two pieces 22 of each brace of the pair of criss-cross braces 18.

Each brace of the pair of criss-cross braces 18 further comprises a plate 26. plate 26 extends telescopically through an inner piece 28 of the two pieces 22 of each brace of the pair of criss-cross braces 18.

The plate 26 of one brace of the pair of criss-cross braces 18 has a throughbore 30.

The plate 26 of the other brace of the pair of criss-cross braces 18 has a threaded rod 32.

The threaded rod 32 extends perpendicularly from the plate 26 of the other brace of the pair of criss-cross braces 18.

The threaded rod 32 extends through the throughslot 24 in the inner piece 28 of one brace of the pair of criss-cross braces 18, through the throughslot 24 in an outer piece 34 of the one brace of the pair of criss-cross braces 18, through the throughslot 24 in the outer piece 34 of the other brace of the pair of criss-cross braces 16, through the throughslot 24 in the inner piece 28 of the other brace of the pair of criss-cross braces 18, through the throughbore, 30 in the plate 26 of the inner piece 28 of the other brace of the pair of criss-cross braces 18, back out through the throughslot 24 in the inner piece 28 of the other brace of the pair of criss-cross braces 18, and back out through the throughslot 24 in the outer piece 34 of the other brace of the pair of criss-cross braces 18 where it threadably engages a wing nut 36 so as to allow for length adjustment and relative orientation of the pair of crisscross braces 18.

It will be understood that each of the elements described above, or two or more together, may also find a useful application in other types of constructions differing from the types described above.

While the invention has been illustrated and described as embodied in a book shelf support for standing on a floor and unattachably abutting against a wall, however, it is not limited to the details shown, since it will be understood that various omissions, modifications, substitutions and changes in the forms and details of the device illustrated and its operation can be made by those skilled in the art without departing in any way from the spirit of the present invention.

While further analysis, the foregoing will so fully reveal the gist of the present invention that others. can, by applying current knowledge, readily adapt it for various applications without omitting features that, from the standpoint of prior art, fairly constitute characteristics of the generic or specific aspects of this inventions

The invention claimed is:

1. A book shelf support for standing on a floor and unattachably abutting against a wall, comprising:

a) a pair of uprights; and b) a pair of criss-cross braces;

wherein said pair of uprights are for standing on the floor and unattachably abutting against the wall; and wherein said pair of criss-cross braces attach the pair of uprights to each other, wherein each brace of said pair of criss-cross braces comprises two pieces; and wherein said two pieces of each brace of said pair of criss-cross braces telescope relative to each other, respectively, wherein each piece of said two pieces of each brace of said pair of criss-cross braces has a throughslot; and wherein said throughslot extends longitudinally along each piece of said two pieces of each brace of said pair of criss-cross braces, wherein each brace of said pair of criss-cross braces includes a plate; and wherein said plate extends telescopically through an inner piece of said two pieces of each brace of said pair of criss-cross braces.

2. The support as defined in claim 1, wherein each upright of said pair of uprights has a lowermost end; and wherein said lowermost end of each upright of said pair of uprights extends inwardly away from the wall and downwardly onto the floor, and as a result thereof, allows the book shelf support to stand on the floor and unattachably abut against the wall.

3. The support: as defined in claim 1, wherein said plate of one brace of said pair of criss-cross braces has a throughbore.

4. The support as defined in claim 3, wherein said plate of the other brace of said pair of criss-cross braces has a threaded rod;

wherein said threaded rod extends perpendicularly from said plate of the other brace of said pair of criss-cross braces.

5. The support as defined in claim 4, wherein said threaded rod extends through said throughslot in said inner piece of one brace of said pair of criss-cross braces, through said throughslot in an outer piece of said one brace of said pair of criss-cross braces, through said throughslot in an outer piece of the other brace of said pair of criss-cross braces, through said throughslot in said inner piece of said other brace of said pair of criss-cross braces, through said throughbore in said plate of said inner piece of said other brace of said pair of criss-cross braces, back out through said throughslot in said inner piece of said other brace of said pair of criss-cross braces, and back out through said throughslot in said outer piece of said other brace of said pair of criss-cross braces where it threadably engages a wing nut so as to allow for length adjustment and relative orientation of said pair of criss-cross braces.

* * * * *